US012331503B2

(12) United States Patent
Hillsten

(10) Patent No.: US 12,331,503 B2
(45) Date of Patent: Jun. 17, 2025

(54) DRAIN INSERTS FOR DIVERTING THE FLOW OF DEBRIS AND FLUIDS

(71) Applicant: Justin Hillsten, Glendale, AZ (US)

(72) Inventor: Justin Hillsten, Glendale, AZ (US)

( * ) Notice: Subject to any disclaimer, the term of this patent is extended or adjusted under 35 U.S.C. 154(b) by 0 days.

(21) Appl. No.: 17/832,244

(22) Filed: Jun. 3, 2022

(65) Prior Publication Data

US 2023/0392359 A1 Dec. 7, 2023

(51) Int. Cl.
*E03C 1/262* (2006.01)
*E03C 1/264* (2006.01)

(52) U.S. Cl.
CPC ..... *E03C 1/262* (2013.01); *E03C 1/264* (2013.01)

(58) Field of Classification Search
CPC ..... E03C 1/262; E03C 1/264; A47K 1/14
See application file for complete search history.

(56) References Cited

U.S. PATENT DOCUMENTS

| | | | | |
|---|---|---|---|---|
| 10,612,222 | B2 * | 4/2020 | Hillsten | E03C 1/264 |
| 10,982,425 | B1 * | 4/2021 | Grumbach | E03F 5/041 |
| 2008/0282466 | A1 | 11/2008 | Swan | |
| 2010/0000012 | A1 * | 1/2010 | Evans | E03F 5/0402 4/292 |
| 2012/0060274 | A1 | 3/2012 | Dunkin | |
| 2016/0265204 | A1 | 9/2016 | Zito | |
| 2017/0030060 | A1 | 2/2017 | Ali | |
| 2017/0073948 | A1 * | 3/2017 | Terrell | A47K 1/14 |
| 2017/0321401 | A1 | 11/2017 | Beck et al. | |
| 2018/0106025 | A1 | 4/2018 | Schuster | |
| 2018/0171610 | A1 | 6/2018 | Ahuja et al. | |

* cited by examiner

*Primary Examiner* — Janie M Loeppke
(74) *Attorney, Agent, or Firm* — UCLA Patent Law Clinic

(57) ABSTRACT

Drain inserts for diverting the flow of debris and fluids in accordance with embodiments of the invention are disclosed. In one embodiment, a drain insert is provided, the drain insert including: a primary opening for receiving flow of debris and fluids, the primary opening comprising a rim that is configured to sit on top of a drain hole; a primary chute that extends from the primary opening and extends beyond a pivot rod of a drain thereby preventing the flow of debris and fluids from making contact with the pivot rod.

12 Claims, 7 Drawing Sheets

DRAIN INSERTS FOR DIVERTING THE FLOW OF DEBRIS AND FLUIDS

FIELD OF THE INVENTION

The present invention generally relates to drain plugs and more specifically to drain inserts for diverting the flow of debris and fluids.

BACKGROUND

Sinks and other water basins, often bowl-shaped, are plumbing fixtures often used for washing hands, dishwashing, caring for hair, and other purposes. Sinks may have faucets that supply hot and/or cold water. Further, sinks may include drains that allow water to be discarded. Typically, drains may include a pivot rod that may attach to a drain pop-up stopper via a lift rod, where a user may raise or lower the lift rod causing the stopper to be plugged or opened, respectively.

SUMMARY OF THE INVENTION

The various embodiments of the present drain inserts for diverting the flow of debris and fluids (may be referred to as "drain inserts") contain several features, no single one of which is solely responsible for their desirable attributes. Without limiting the scope of the present embodiments, their more prominent features will now be discussed below. In particular, the present drain inserts will be discussed in the context of sink drains. However, the use of sink drains is merely exemplary and various other drains such as, but not limited to, kitchen sink drains, shower drains, etc. may be utilized with the present drain inserts as appropriate to the requirements of a specific application in accordance with various embodiments of the invention. After considering this discussion, and particularly after reading the section entitled "Detailed Description," one will understand how the features of the present embodiments provide the advantages described here.

One aspect of the present embodiments includes the realization that in current drain pop-up stoppers (may be referred to as "pop-up stoppers") and similar inserts, the potential for clogging within the drain pipes remains quite high. For example, the drains of most basins, such as sinks, contain a diametric pivot rod that attaches to a drain pop-up stopper. The function of the pop-up stopper is to either be plugged or to be opened, namely through use of a lift rod, to allow for drainage of the basin. The pivot rod is typically a metal bar that pivots underneath the sink to raise or lower the sink stopper. It is not optimized to catch debris (e.g., hair). Although various drain strainers and traps have been developed to work with pop-up stoppers to restrict the flow of debris, their use still incur the problems described herein. For example, drain pivot rods, pop-up stoppers, strainers, and traps tend to block the flow of water down the drain as they accumulate debris, and thus require regular manual cleaning to function properly. Drain pivot rods, pop-up stoppers, strainers, and traps that have accumulated organic debris, such as human hair and residue from hygiene products, are both unsightly and unsanitary and often promote the growth of microbes. The present embodiments solve these problems by providing a designated channel through which the flow of debris and fluids may be consolidated within a chute and directed down the drain, bypassing the pivot rod, where most clogs, such as hair clogs, proceed to form. The present embodiments thus advantageously enable a clog-free and low maintenance drain, where the drain insert fits into standard sink drains and funnels the flow of debris and fluids to one part of the drain thereby bypassing the pivot rod. The present embodiments reduce the risk of clogs associated with pop-up stoppers, strainers, traps, etc. The present embodiments provide these advantages and enhancements, as described below.

In a first aspect, a drain insert is provided, the drain insert comprising a primary opening for receiving flow of debris and fluids, the primary opening comprising a rim that is configured to sit on top of a drain hole; a primary chute that extends from the primary opening and extends beyond a pivot rod of a drain thereby preventing the flow of debris and fluids from making contact with the pivot rod.

In an embodiment of the first aspect, the drain insert further comprises a secondary chute.

In another embodiment of the first aspect, the secondary chute is positioned at an incline relative to a horizontal plane of the sinkhole, angled inwards towards the primary chute, allowing the drain insert to selectively filter specific types of debris. In another embodiment of the first aspect, the drain insert further comprises an extension configured to extend from the primary chute and extend beyond a pivot rod of a drain thereby preventing the flow of debris and fluids from making contact with the pivot rod.

In another embodiment of the first aspect, the primary chute is concave.

In another embodiment of the first aspect, the secondary chute is concave.

In another embodiment of the first aspect, the secondary chute is made with a malleable material.

In another embodiment of the first aspect, the primary chute further comprises a plurality of holes that facilitates escape of air from the drain insert, reducing pressure and increasing flow velocity.

In another embodiment of the first aspect, the drain insert is made using anti-microbial material.

In another embodiment of the first aspect, the drain insert is made using thermoplastic.

In another embodiment of the first aspect, the drain insert is made using a metallic coating.

In another embodiment of the first aspect, the drain insert is made using a high-density silicone.

In another embodiment of the first aspect, the drain insert is made using metal.

In another embodiment of the first aspect, the primary chute and the secondary chute form a unified body.

In another embodiment of the first aspect, the primary opening is circular having a circumstance that allows the primary opening to receive a drain stopper.

In another embodiment of the first aspect, the extension is flat.

In another embodiment of the first aspect, the extension is concave.

In another embodiment of the first aspect, the extension is concave forming a curvature, wherein a length and a radius of the curvature is equivalent to a length and a radius of a curvature of the primary chute, respectively.

In another embodiment of the first aspect, the extension extends from the primary chute at an incline relative to a horizontal plane of the drain hole, angled outwards away from the primary chute, thereby facilitating the flow of debris and water away from the pivot rod of the drain.

In another embodiment of the first aspect, the extension is attached to the pivot rod of the drain.

BRIEF DESCRIPTION OF THE DRAWINGS

The various embodiments of the present drain inserts will now be discussed in detail with an emphasis on highlighting the advantageous features. These embodiments depict the novel and non-obvious drain inserts shown in the accompanying drawings, which are for illustrative purposes only. These drawings include the following figures.

DETAILED DESCRIPTION OF THE DRAWINGS

Figure 1:
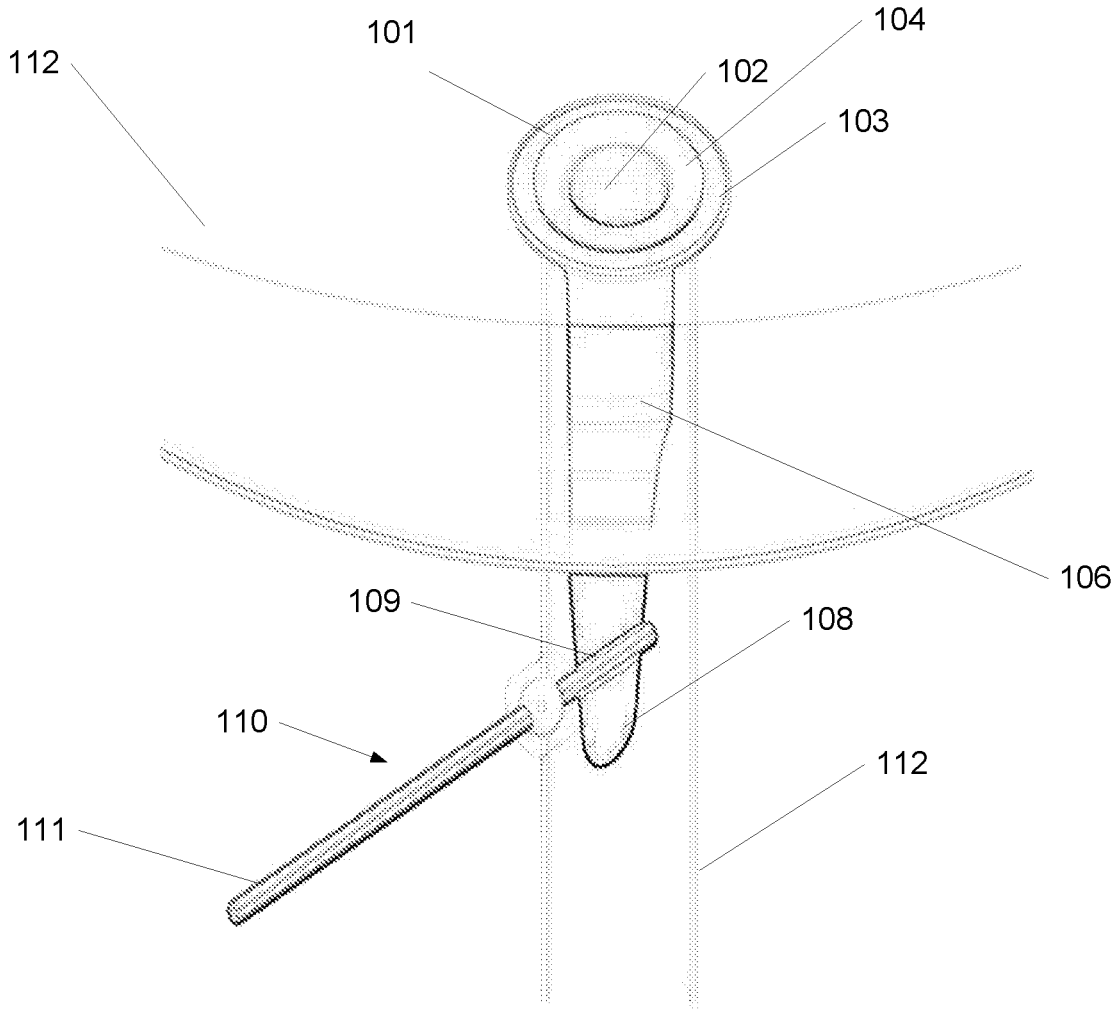
FIG. 1 is a diagram illustrating a drain insert inside of a sink drain in accordance with an embodiment of the invention.

The following detailed description describes the present embodiments with reference to the drawings. In the drawings, reference numbers label elements of the present embodiments. These reference numbers are reproduced below in connection with the discussion of the corresponding drawing features.

Turning now to the drawings, drain inserts for diverting the flow of water and debris in accordance with embodiments of the invention are illustrated. In many embodiments, drain inserts may include a primary opening, a primary chute, a secondary chute, and/or an extension. In several embodiments, the primary opening may include an upper rim that may be configured to sit on top of a drain hole. In various embodiments, a primary chute may extend from the primary opening and extend beyond a pivot rod of the drain, thereby preventing the flow of debris and fluids from making contact with the pivot rod. In various embodiments, drain inserts may allow for bypassing of the pivot rod in the drainage of water and debris as a common reason that drains may clog is the buildup of debris (e.g., hair) at the pivot rod.

In some embodiments, the drain inserts may include an extension that may be configured to extend from the primary chute and extend beyond a pivot rod thereby allowing for further bypassing of the pivot rod. In some embodiments, the extension may attach to the pivot rod of the drain. For example, in some embodiments, the extension may attach to the pivot rod by an adhesive material, a hook, a clasp, etc. In various embodiments, the extension may extend from the primary chute at an angle (e.g., an incline relative to a plane of the drain hole), further facilitating the flow of debris and water away from the pivot rod of the drain. In various embodiments, the extension may be concave forming a curvature. In some embodiments, a length and a radius of the curvature of the extension may be equivalent to a length and a radius of a curvature of the primary chute, respectively.

In some embodiments, the secondary chute may be positioned at an angel (e.g., an incline relative to a horizontal plane of a sinkhole), allowing the drain insert to selectively filter specific types of debris by shape and size. In several embodiments, the primary chute and the secondary chute may be concave. In many embodiments, drain inserts may be made using thermoplastics, metals, and/or high-density silicone, all or some of which may also include antimicrobial additives. In some embodiments, the primary chute may include a plurality of holes that facilitate the escape of air through the drain insert, promoting greater efficiency in the flow of fluids and debris through the primary chute. Drain inserts in accordance with embodiments of the invention are further discussed below.

Drain Inserts

Drain inserts can be utilized to divert the flow of debris and fluids down a drain hole past the pivot rod of the drain. A diagram illustrating a drain insert inside of a sink drain in accordance with an embodiment of the invention is shown in FIG. 1. In a standard drain (prior to utilizing the present drain inserts), a lift rod (not pictured) may be attached to a pivot rod 110 at a first end 111, and a second end 109 of the pivot rod 110 may be connected to a drain stopper (not pictured). When the lift rod is pulled by the user, the first end 111 of the pivot rod 110 may pull up which pulls down the second end 109 and the drain stopper, thereby closing the drain. As described above, both the drain stopper and the pivot rod 110 may be a significant contributor to the clogging of drains (e.g., drain 112), as certain types of debris, such as hair, may wrap around and envelop the drain stopper and/or the pivot rod 110. As the debris accumulates, the debris may increase in size, reducing the amount of free space in the drain 112, thus impeding the flow of debris and fluids until the debris is removed from the drain stopper and the pivot rod 110.

In reference to FIG. 1, the drain insert 101 may include a primary opening 102 with an upper rim 104 having a diameter that allows the upper rim 104 to sit on top of a drain hole 103. The drain insert 101 may also include a primary chute 106 and an extension 108 extending from the primary chute 106 and beyond the pivot rod 108 of the drain 112. In many embodiments, the extension 108 may comprise a flat surface created by an extrusion of the primary chute 106. In several embodiments, the extension 108 may extend from the primary chute 106 and extend beyond the pivot rod 110, thereby preventing the flow of debris and fluids from making contact with the pivot rod 110. In some embodiments, the extension 108 may extend from the primary chute 106 at an incline relative to the horizontal plane of the drain hole 103, angled outwards away from the primary chute, further preventing the flow of debris and fluids from making contact with the pivot rod 110. For example, the extension 108 may extend from the primary chute 106, such that the primary chute 106 and extension 108 form an angle greater than ninety degrees but less than one hundred eighty degrees, with the point at which the primary chute 106 and extension 108 meets serving as the pivot point of the angle. When the primary chute 106 and the extension 108 form an angle less than ninety degrees, the extension 108 may not effectively channel the flow of debris and fluids down the drain. The flow of debris and fluids may fill the space between the primary chute 106 and the extension 108, potentially leading to overflow and spillover, which may increase the probability of contact between the flow of debris and fluids and the pivot rod 110 of the drain. When the primary chute 106 and the extension 108 form an angle less than one hundred eighty degrees, the distance between the extension 108 and the pivot rod 110 increases, which, in turn, decreases the probability of contact between the flow of debris and fluids and the pivot rod 110 of the drain. For a more illustrative example, consider a clock. Suppose the primary chute represents the long hand of a clock, specifically at 12 o'clock, the extension represents the short hand of the clock, and the point at which the primary chute and extension meets represents the center of the clock. The primary chute and the extension may form an angle, representing a time between 3 o'clock and 9 o'clock, depending on the direction at which the primary chute is facing.

In several embodiments, the extension 108 may be in contact with the pivot rod 110. For example, the extension 108 may rest against the pivot rod 110 or may be attached to the pivot rod 110. The extension 108 may connect to the pivot rod 110 of the drain may include, but is not limited to, adhesive material, a hook, a clasp, etc. In a variety of embodiments, the extension 108 may be narrowed to accommodate the multitude of drain pipe configurations. In various embodiments, the extension 108 may be concave. The concavity of the extension 108 allows the extension 108 to more effectively contain the flow of debris and fluids, preventing the flow of debris and fluids from spilling over the edges of the extension 108 and making contact with the pivot rod 110 of the drain. In some embodiments, the extension 108 may be concave, forming a curvature, where the length and the radius of the curvature of the extension 108 is equivalent to the length and the radius of the curvature of the primary chute 106, respectively, as further described below.

In many embodiments, the primary opening 102, the primary chute 106, and the extension 108, as well as all other component parts described herein, may be made using thermoplastic, such as acrylonitrile butadiene styrene or polyethylene. The thermoplastic may also include an antimicrobial additive. In several embodiments, the primary opening 102, the primary chute 106, and the extension 108, as well as all other component parts, may be made using a high-density silicone. The high-density silicone may also include an antimicrobial additive. The primary opening 102, the primary chute 106, and the extension 108, as well as all other component parts may be coated with a coating. The coating may be metallic. The coating may be hydrophobic. The coating may be antimicrobial. In various embodiments, the primary opening 102, the primary chute 106, and the extension 108, as well as all other component parts may comprise a metal or a combination of metal and previously mentioned materials. The metal may be stainless steel or chrome. The metal may be made to cosmetically and materially match the metals used in drain flanges.

The drain insert 101 may be manufactured by an injection molding process. The injection molding process may comprise a unified molding of the primary opening 102, the primary chute 106, extension 108, and secondary chute (not pictured). The injection molding process may use overmolding to vary the composition of the primary chute 106 from the secondary chute. The secondary chute may be molded onto the primary opening 102, with the primary chute 106 molded separately, after which the primary chute may be attached to the primary opening, resulting in an embodiment of the drain insert. Separating the two parts as described above may increase the efficiency by which the drain insert may be produced through the injection molding process, especially when designing the secondary chute. The injection molding process may use insert molding to vary the composition of the primary opening 102, namely the upper rim 104, from the primary chute 106. The drain insert 101 may be manufactured by a multi-step liquid silicone rubber molding process. The multi-step liquid silicone rubber molding process may include a unified molding of the primary opening 102, the primary chute 106, extension 108, and secondary chute (not pictured). The drain insert 101 may be manufactured by a 3D printing process. The 3D printing process may use multiple filament types including but not limited to metal, thermoplastic, and elastomer. The drain insert 101 may be manufactured by a metal casting process. The metal casting process may include a unified casting of the primary opening 102, the primary chute 106, extension 108, and secondary chute (not pictured). The secondary chute may be cast separate from the rest of the embodiment and fastened to the primary opening 102. The drain insert may comprise stamped metal, folded and welded. In many embodiments, the drain insert 101 may be made using one process, such that each component part may share the same material composition. In several embodiments, the drain insert 101 may be made using a plurality of processes, such that each component part may differ in material composition. For example, the drain insert may include a mixture of thermoplastic and metallic components, where the primary chute 106 is made using metal, and the extension 108 is made using thermoplastic, or vice versa.

Although specific drain inserts for diverting the flow of debris and fluids are discussed above with respect to FIG. 1, any of a variety of drain inserts including a primary opening and a primary chute as appropriate to the requirements of a specific application can be utilized in accordance with embodiments of the invention. Drain inserts having primary chutes in accordance with embodiments of the invention are discussed further below.

Primary Chutes of Drain Inserts

Drain inserts may include a primary chute for directing the flow of debris and fluids down the drain hole. In a standard drain set-up, a drain stopper is attached to a pivot rod as part of a broader system for permitting and/or preventing the entry of the flow of debris and fluids into the drain, as described above. Instead of flowing through the drain stoppers, the flow of debris and fluids travels around the drain stopper, making contact with the drain stopper itself as well as the pivot rod of the drain almost inevitable. Primary chutes address these issues by directing the flow of debris and fluids down one side of the pivot rod of the drain, ultimately causing the flow of debris and fluids to bypass the pivot rod. In many embodiments, the flow of debris and fluids may pass through the primary chute, thereby also eliminating the probability of clogged drains caused by debris wrapped around the drain inserts.

Figure 2:
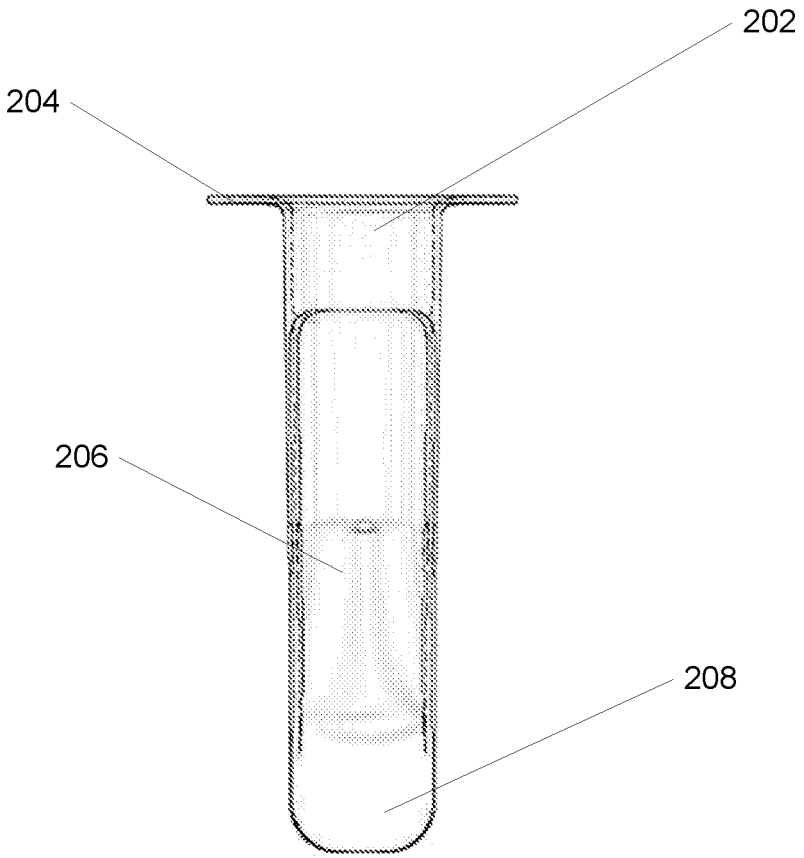
FIG. 2 is a front view of a drain insert in accordance with an embodiment of the invention.

A front view of a drain insert in accordance with an embodiment of the invention is shown in FIG. 2. In reference to FIG. 2, the drain insert includes a primary opening 202, an upper rim 204, and a primary chute 206. The upper rim 204 may be configured to have a diameter that allows the upper rim to sit on top of a drain hole. The primary chute 206 may be defined by a lofting function. The lofting function may take two planar surfaces as parameters and define a continuous series of planar sections along a linear path between them. The parameters of the lofting function may be a ring and a bottom surface. The primary chute 206 is configured to have a length that allows the primary chute to extend beyond the pivot rod of the drain. In several embodiments, the primary chute 206 may be concave, preventing the flow of debris and fluids from spilling out of the primary chute. In many embodiments, the drain insert may include an extension 208, as described above. In various embodiments, the primary chute 206 may differ in concavity at different regions of the primary chute 206. For example, the primary chute 206 may extend from the primary opening 202 with a strong curvature, but bear a reduced curvature, or become flatter, as the primary chute 206 extends down the drain.

Figure 3:
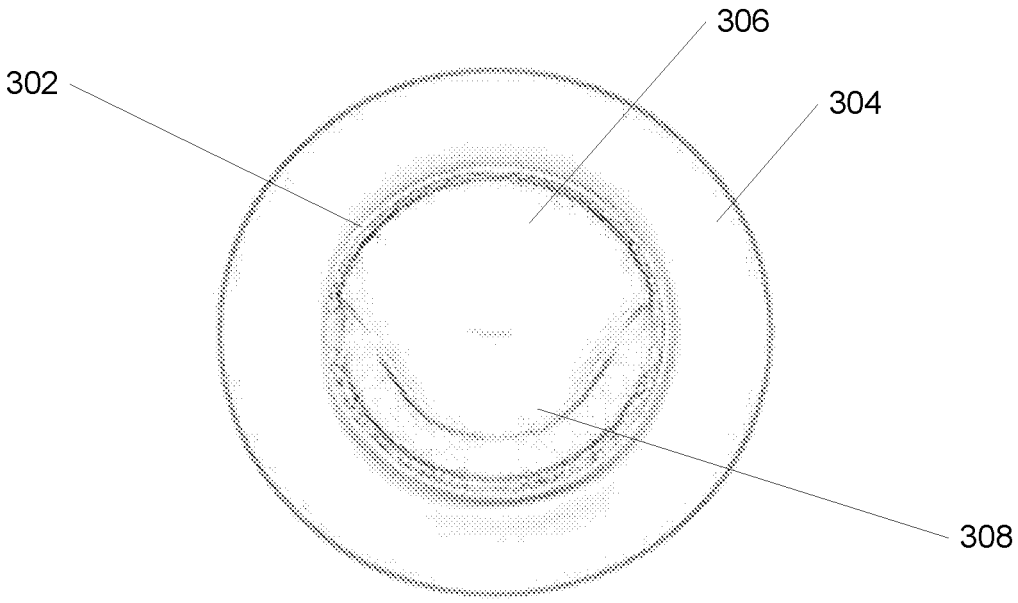
FIG. 3 is a top view of a drain insert in accordance with an embodiment of the invention.

A top view of a drain insert in accordance with an embodiment of the invention is shown in FIG. 3. In reference to FIG. 3, the drain insert may include a primary opening 302, an upper rim 304, and a primary chute extends 306, as described above. In many embodiments, the primary chute 306 may be configured to divert the flow of debris and fluids into one part of the drain, as the primary chute 306 and/or the extension 308 may rest against or attach to the pivot rod of the drain, which divides the drain into two equal or unequal parts, depending on whether the pivot rod is unequivocally diametric.

Although specific primary chutes are discussed above with respect to FIGS. 2-3, any of a variety of primary chutes for drain inserts as appropriate to the requirements of a specific application can be utilized in accordance with embodiments of the invention. Drain inserts having primary chutes and secondary chutes in accordance with embodiments of the invention are discussed further below.

Drain Inserts with Primary and Secondary Chutes

Figure 4:
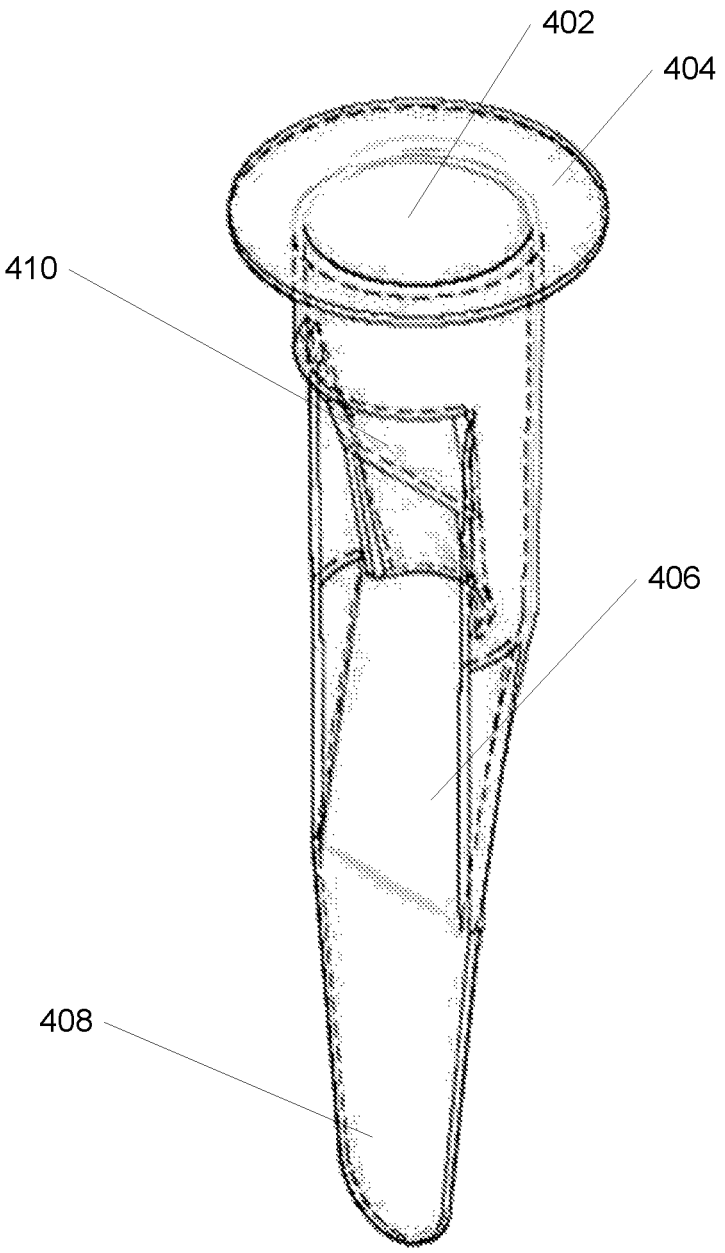
FIG. 4 is a perspective view of a drain insert having a secondary chute in accordance with an embodiment of the invention.

Drain inserts having a primary and a secondary chute can be utilized to further streamline the flow of debris and fluids down the drain hole as well as to selectively filter specific types of debris, namely by shape and size. A perspective view of a drain insert having a secondary chute in accordance with an embodiment of the invention is shown in FIG. 4. In reference to FIG. 4, the drain insert may include a primary opening 402 and an upper rim 404. In many embodiments, a secondary chute 410 may extend from the primary opening 402. In drain inserts without the secondary chute 410, the diameter and circumference of the primary opening 402 may determine the nature of the debris flowing down the drain hole. The secondary chute provides an element of customizability by selectively filtering specific types of debris by allowing the user to position the secondary chute 410 at different angles, resulting in the increasing or decreasing of the space between the primary chute 406 and the secondary chute 410. The secondary chute 410 may be defined by a lofting function. The lofting function may take two planar surfaces as parameters and define a continuous series of planar sections along a linear path between them. The parameters of the lofting function may be a ring and a bottom surface. In many embodiments, the secondary chute 410 may extend from the upper rim and remain in a fixed position. In various embodiments, the secondary chute 410 may be in parallel with the primary chute. In many embodiments, the secondary chute 410 may be at a decline relative to the horizontal plane of the sinkhole, angled inwards towards direction of the primary chute, allowing the drain insert to selectively filter specific types of debris. The secondary chute 410 may be made using malleable material, allowing the secondary chute to be adjusted to be positioned at different angles. For example, the user may wish to decrease the space between the primary chute 406 and the secondary chute 410 by attaching the secondary chute 410 at a forty-five degree angle relative to the horizontal plane of the drain hole rather than at a eighty degree angle relative to the horizontal plane of the drain hole. In several embodiments, the secondary chute 410 may be attached or detached to the upper rim, such that the user may adjust the angle at which the secondary chute 410 is positioned to best accommodate the unique needs of each respective user. The ability to adjust the positioning of the secondary chute, such as by either adjusting the angle of the secondary chute made using malleable material or by attaching and/or detaching the secondary chute from the upper rim, facilitates further customizability of the drain insert by permitting a variety of secondary chute configurations while using one drain insert. In many embodiments, the secondary chute 410 may be flat. In some embodiments, the secondary chute 410 may be concave. In various embodiments, the secondary chute may have both a flat component and a concave component. For example, the secondary chute 410 may extend flat from the primary opening 402 and possess a curvature thereafter. The secondary chute 410 may have a concavity with an arc length equal to or less than the arc length of the primary chute 406, such that the secondary chute 410 may fit into the primary chute 406. In various embodiments, the primary chute 406 and the secondary chute 410 may be connected, forming a unified body.

Figure 5:
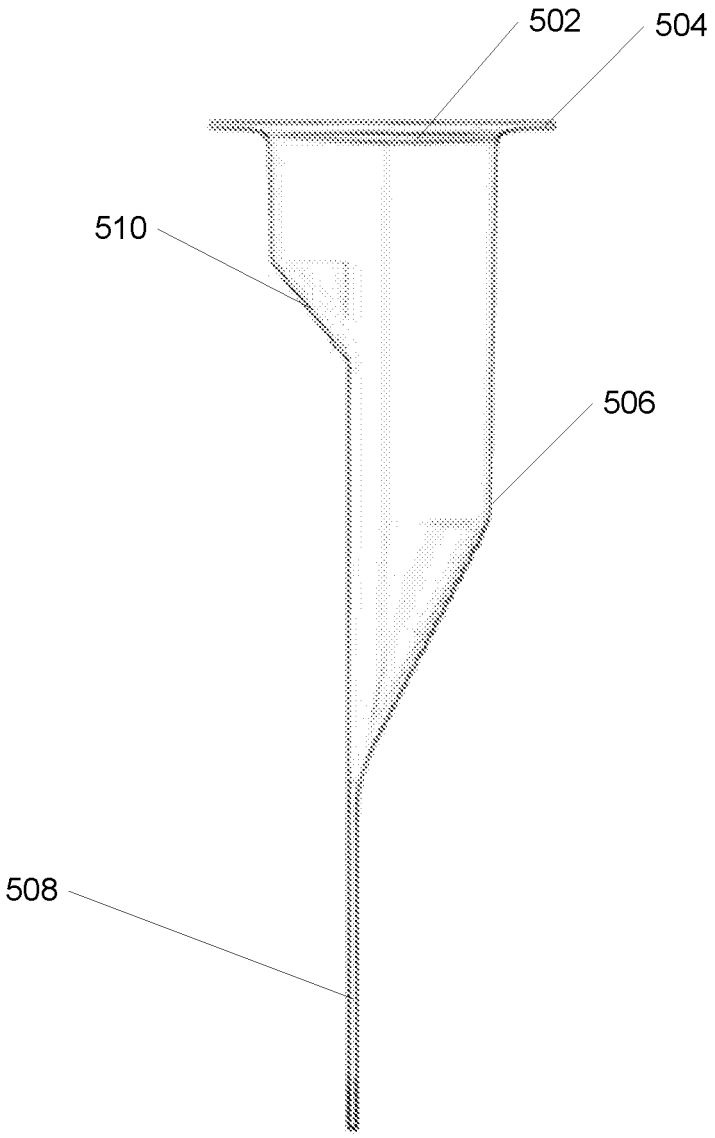
FIG. 5 is a side view of a drain insert having a secondary chute in accordance with an embodiment of the invention.

A side view of a drain insert having a secondary chute in accordance with an embodiment of the invention is shown in FIG. 5. In reference to FIG. 5, the drain insert may include a primary opening 502, an upper rim 504, and a primary chute 506. The drain insert may also include an extension 508 that may vary in length in order to accommodate for various drain configurations. For example, if the pivot rod of the drain occupies an area further down in the drain, the extension 508 may have a greater length that allows the extension 508 to rest against or attach to the pivot rod.

Although specific drain inserts for diverting the flow of debris and fluids are discussed above with respect to FIGS. 4 and 5, any of a variety of drain inserts incorporating a secondary chute as appropriate to the requirements of a specific application can be utilized in accordance with embodiments of the invention. Drain inserts utilizing holes in accordance with embodiments of the invention are discussed further below.

Drain Inserts with Holes for Enhanced Flow

Figure 6:
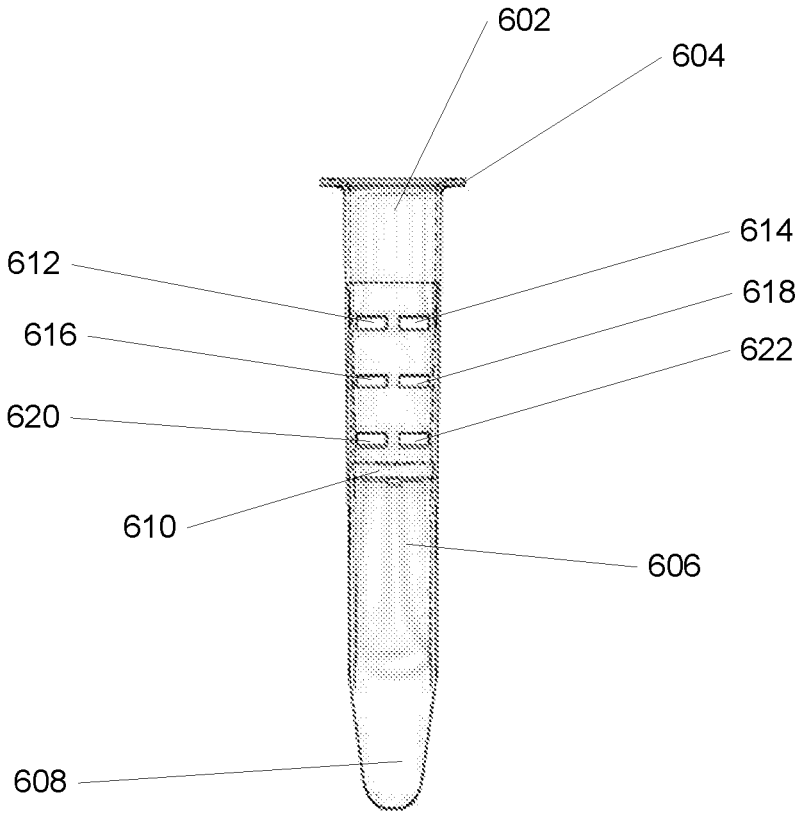
FIG. 6 is a front view of a drain insert with a secondary chute having a plurality of holes in accordance with an embodiment of the invention.

Drain inserts with a primary chute and/or a secondary chute may include a plurality of holes to enhance the flow of fluids and debris down the drain hole. In some embodiments, the plurality of holes may be configured as vents. In some embodiments, the plurality of holes may be vented and/or covered. A front view of a drain insert with a secondary chute having a plurality of holes in accordance with an embodiment of the invention is shown in FIG. 6. As illustrated in FIG. 6, the drain insert may include a primary opening 602, an upper rim 604, a primary chute 606, and a secondary chute 610. In various embodiments, the secondary chute 610 may have a plurality of holes 612, 614, 616, 618, 620, 622. In many embodiments, the plurality of holes 612, 614, 616, 618, 620, 622 may be arranged in a plurality of columns, with the columns parallel to each other, each column having an equal number of holes, and with each hole of the plurality of holes 612, 614, 616, 618, 620, 622 sharing the same height and length. The use of a plurality of holes on the secondary chute 610 provides an avenue through which air may escape the drain insert, which decreases the pressure within the drain insert, thereby increasing the velocity of the flow of debris and fluids.

Figure 7:
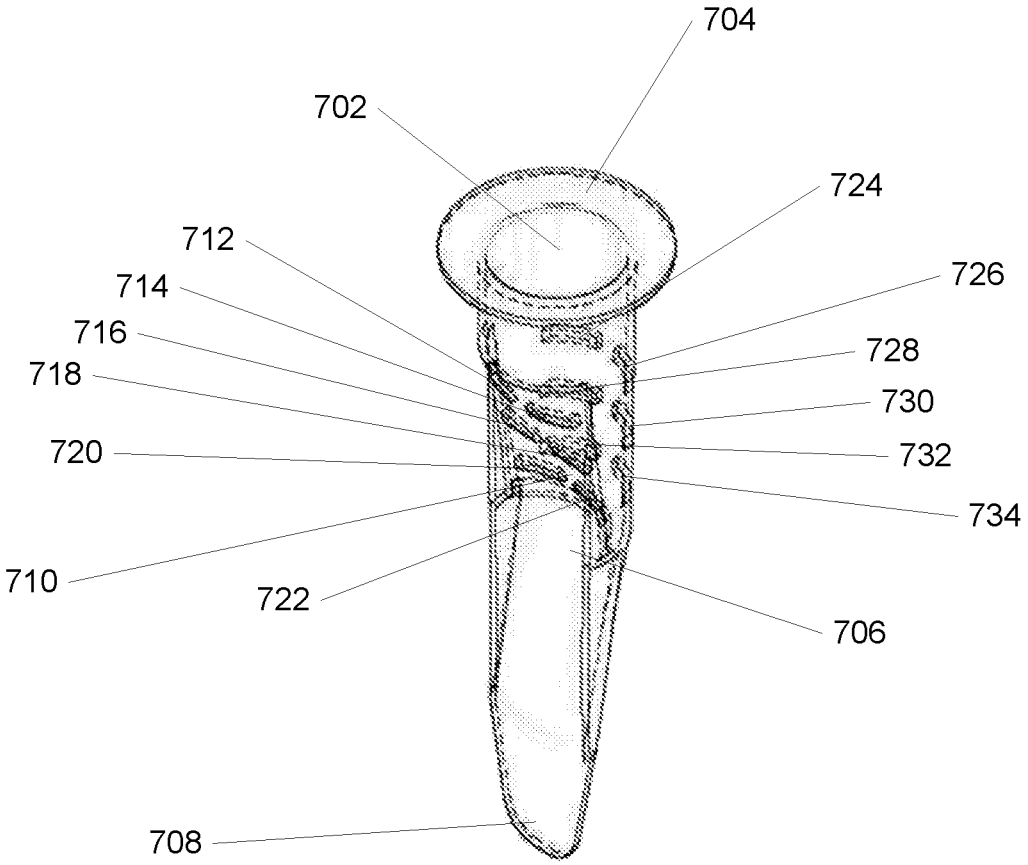
FIG. 7 is a perspective view of a drain insert with a primary chute and a secondary chute, both having a plurality of holes, in accordance with an embodiment of the invention.

A perspective view of a drain insert with a primary chute and a secondary chute, both having a plurality of holes, in accordance with an embodiment of the invention is shown in FIG. 7. In reference to FIG. 7, the drain insert may include a primary opening 702, an upper rim 704, a primary chute 706, and a secondary chute 710. In many embodiments, the primary chute 706 may have a plurality of holes 724, 726, 728, 730, 732, 734. Depending on the desired flow velocity, both the primary chute 706 and the secondary chute 710 may have a plurality of holes 712, 714, 716, 718, 720, 722, 724, 726, 728, 730, 732, 734 or the primary chute 706 may have a plurality of holes 724, 726, 728, 730, 732, 734 while the secondary chute 710 does not and vice versa. Moreover, the plurality of holes 712, 714, 716, 718, 720, 722, 724, 726, 728, 730, 732, 734 may be vented, or otherwise, covered.

Although specific drain inserts utilizing holes for enhanced flow are discussed above with respect to FIGS. 6 and 7, any of a variety of drain inserts utilizing vents such as, but not limited to, holes as appropriate to the requirements of a specific application can be utilized in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A drain insert, comprising:

a primary opening for receiving flow of debris and fluids, the primary opening comprising an upper rim that is configured to sit on top of a drain hole;

a primary chute that extends from the primary opening and extends towards a pivot rod of a drain, wherein the primary chute includes a designated channel through which the debris and fluids are directed down a drain thereby diverting the flow of debris and fluids away from the pivot rod; and an extension configured to extend from the primary chute and extend beyond a pivot rod of a drain, thereby preventing the flow of debris and fluids from making contact with the pivot rod.

2. The drain insert of claim 1, further comprising a secondary chute.

3. The drain insert of claim 2, wherein the secondary chute is positioned at an incline relative to a horizontal plane of the drain hole, angled inwards towards the primary chute, allowing the drain insert to selectively filter specific types of debris.

4. The drain insert of claim 2, wherein the secondary chute is concave.

5. The drain insert of claim 2, wherein the secondary chute is made with a malleable material.

6. The drain insert of claim 2, wherein the primary chute and the secondary chute form a unified body.

7. The drain insert of claim 2, wherein the secondary chute has a concavity with an arc length equal to or less than an arc length of the primary chute.

8. The drain insert of claim 1, wherein the primary chute is concave.

9. The drain insert of claim 1, wherein the primary chute further comprises a plurality of holes that facilitates the escape of air from the drain insert, reducing pressure and increasing flow velocity.

10. The drain insert of claim 1, wherein the drain insert is made using anti-microbial material.

11. The drain insert of claim 1, wherein the primary opening is circular having a circumference that allows the primary opening to receive a drain stopper.

12. The drain insert of claim 1, wherein the extension is flat.

* * * * *